United States Patent [19]

Hennig

[11] Patent Number: 4,566,596

[45] Date of Patent: Jan. 28, 1986

[54] KNOCK-DOWN DISPENSER PACK FOR STACKED ARTICLES

[76] Inventor: Kurt C. Hennig, 2 Arlie Dr., Annapolis, Md. 21401

[21] Appl. No.: 587,912

[22] Filed: Mar. 9, 1984

[51] Int. Cl.[4] ..... A47F 7/00

[52] U.S. Cl. ..... 211/59.2; 211/189; 312/42

[58] Field of Search ..... 211/59.2, 14, 59.4, 211/162, 94.5, 189; 221/92; 206/44.12; 312/42, 45, 118; 229/17 B; 40/124; 403/347, 346

[56] References Cited

U.S. PATENT DOCUMENTS

| | | | |
|---|---|---|---|
| 197,136 | 11/1877 | Huss | 40/124 X |
| 1,079,556 | 11/1913 | Israel | 312/45 |
| 3,744,866 | 7/1973 | Cook | 312/42 |
| 3,938,666 | 2/1976 | Castleberry | 211/59.2 |

FOREIGN PATENT DOCUMENTS

| | | | |
|---|---|---|---|
| 1356956 | 2/1964 | France | 229/17 B |
| 175808 | 3/1922 | United Kingdom | 403/347 |
| 395584 | 7/1933 | United Kingdom | 312/42 |

*Primary Examiner*—Robert W. Gibson, Jr.
*Attorney, Agent, or Firm*—Scrivener, Clarke, Scrivener and Johnson

[57] ABSTRACT

A knock-down rack for stacked articles, such as cigarette packages is disclosed. The rack is easily packed in knock-down condition for shipping purposes and easily assembled at its place of use by use primarily of only a screw driver. The rack includes right angle retainer members having leg ends received in edge slots of upper and lower panels and then trapped therein by strips secured over the slots.

10 Claims, 7 Drawing Figures

KNOCK-DOWN DISPENSER PACK FOR STACKED ARTICLES

The present invention relates to racks for dispensing articles stacked in side-by-side vertical rows and more particularly to a knock-down, easily assembled rack for such articles.

There is a need for racks for stacked articles, such as cigarette packages, which not only display and dispense the articles, but which can be inexpensively shipped and easily assembled at their points of use.

Though the present invention will be described primarily as adapted for displaying and dispensing cigarette packages, it will be apparent that it can be adapted for a variety of other articles, such as photographic film packages, and the like.

Display/dispensing racks of the type referred to are well known, but almost invariably they are essentially pre-assembled which adds enormously to their shipping costs, and this alone restricts their marketability. However, even if modern day racks were to be shipped in knock-down condition, they are often so complicated to assemble that skilled assemblers often must be employed at the point of use, which adds to the cost.

The broad object of the present invention is to provide a knock-down display/dispensing rack for articles, e.g. cigarette packages, which may be packaged in compact shipping containers and after arrival at their points of use, easily assembled by a novice using primarily a screw driver and possibly a drill and hack saw.

Another object of the invention is to provide in a rack of the foregoing nature a novel arrangement for fastening channel members into their positions of use to define individual chutes for articles stacked in side-by-side relationship in said chutes.

Yet another object of the invention is to provide fastening means for certain of the channel members which enables said members to be readily and individually removed and replaced to facilitate loading of said chutes.

Other objects and their attendant advantages will become apparent as the following detailed description is read in conjunction with the accompanying drawings wherein.

Figure 1:
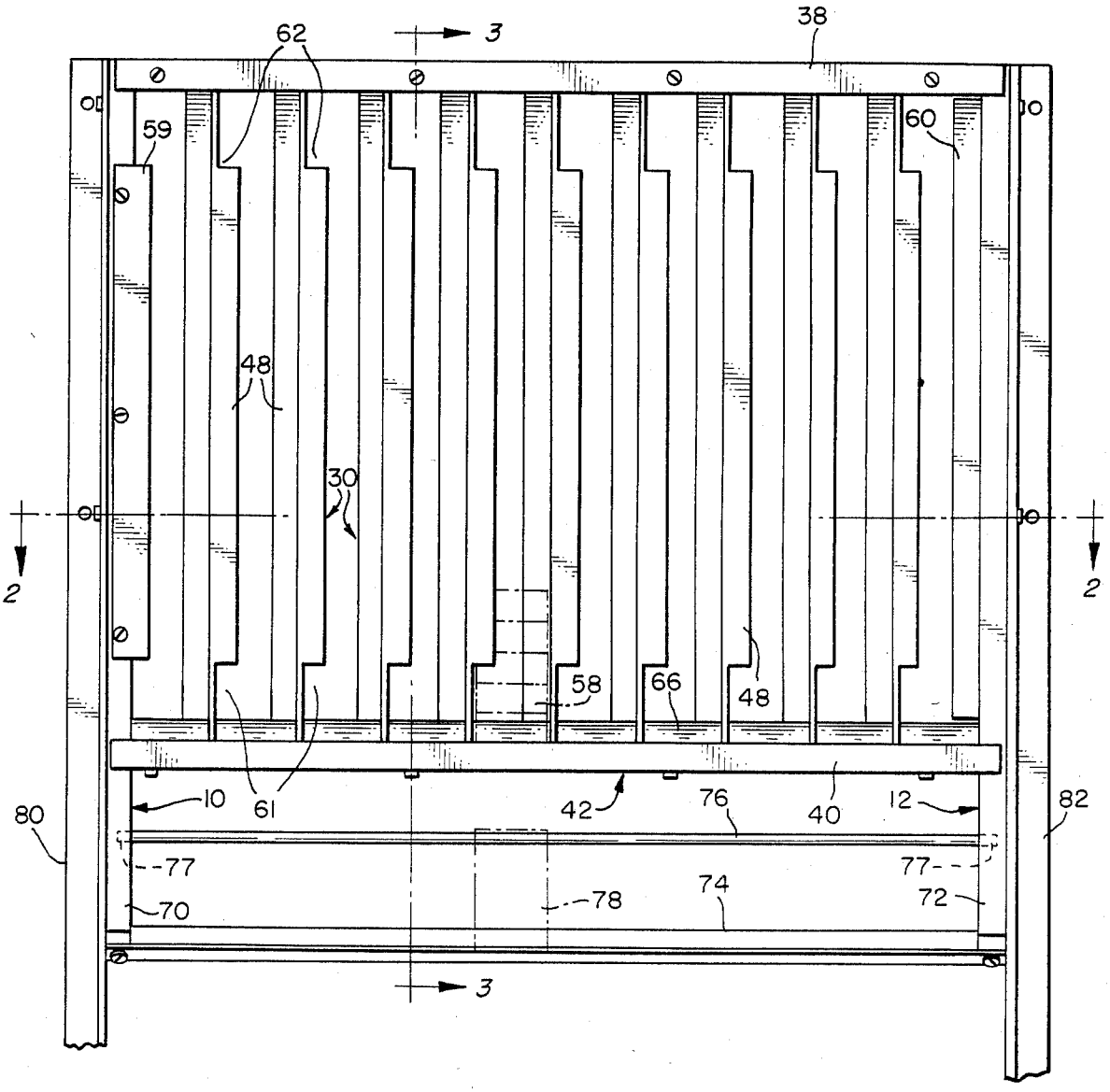
FIG. 1 is a front, vertical elevational view of a knock-down rack in assembled condition.
Figure 2:
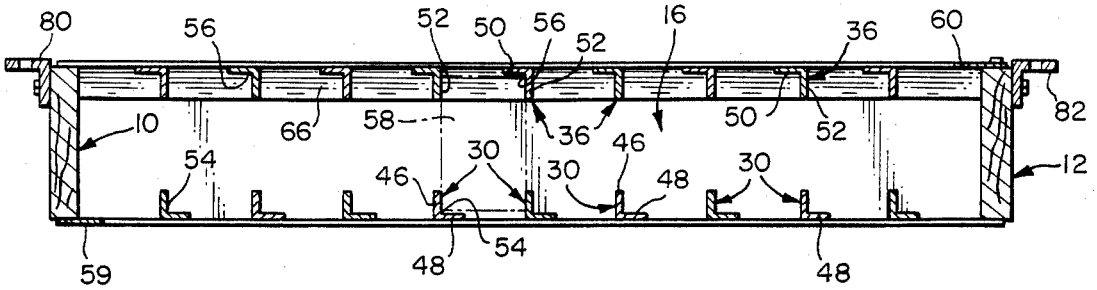
FIG. 2 is a horizontal cross-sectional view taken substantially on the line 2—2 of FIG. 1.
Figure 3:
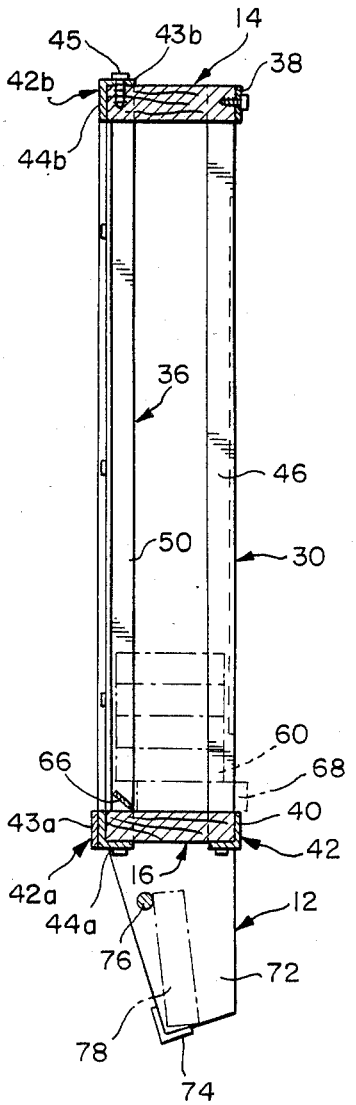
FIG. 3 is a vertical cross-sectional view taken substantially on the line 3—3 of FIG. 1.
Figure 4:
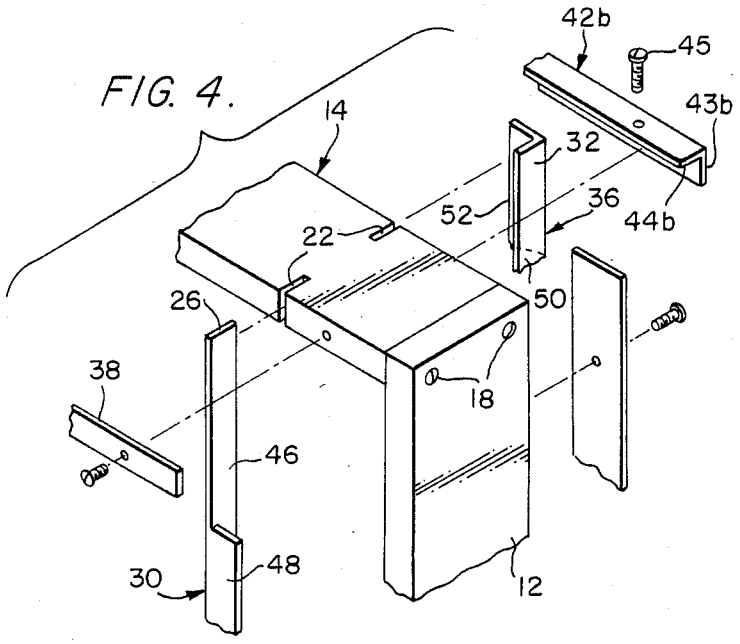
FIG. 4 is an exploded, broken perspective view showing the method of assembling the upper portion of the rack of the invention.
Figure 5:
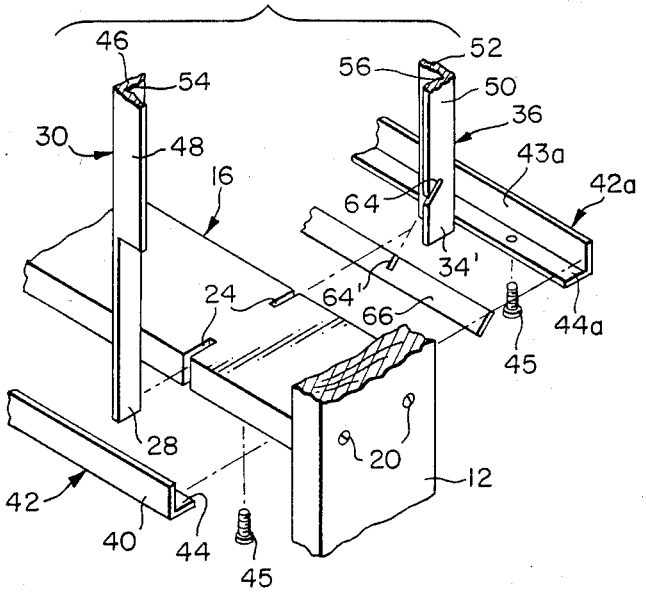
FIG. 5 is an exploded, broken perspective view showing the method of assembling the lower portion of the rack of the invention.
Figure 7:
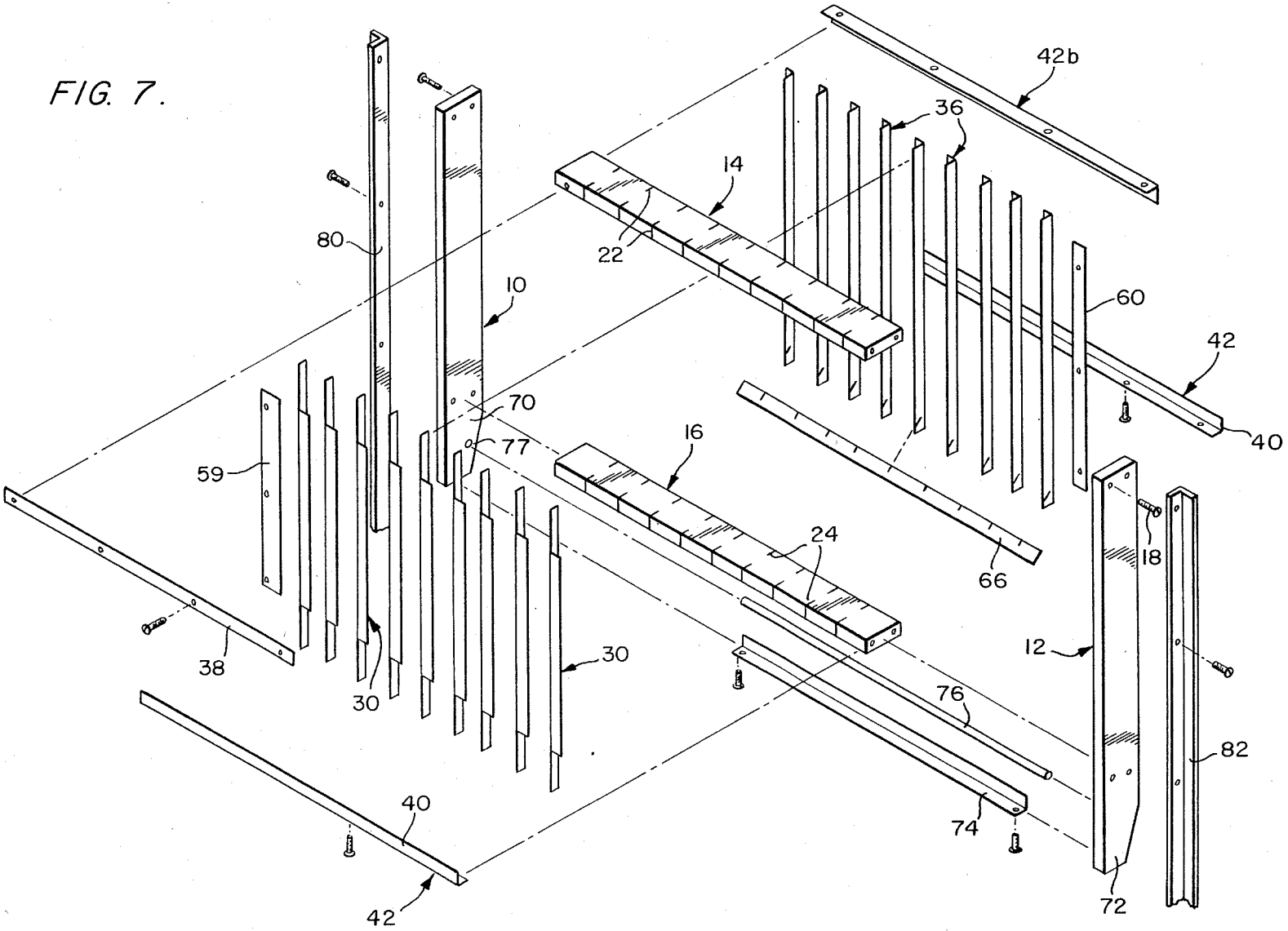
FIG. 7 is an exploded detailed view of an entire rack in its preassembled condition.

Referring now to FIGS. 1, 2 and 3 the rack comprises a pair of end panels 10, 12 desirably of wood, and top and bottom panels 14, 16, also desirably of wood, which are adapted to be connected to the end panels by fasteners such as the screws 18, 20 shown in assembled condition in FIGS. 4 and 5. In FIG. 7 only representative screws are shown as will be obvious upon inspection. A plurality of slots 22, 24 are provided in both side edges of the respective top and bottom panels 14, 16 the spacing between any two adjacent slots being the same in each edge of both of the panels whereby, when the horizontal panels 14, 16 are assembled to the end panels 10, 12, all of the slots in one side edge of a panel align horizontally with all of the slots in the other side edge and also align vertically with the slots in the side edges of the other of the top and bottom panels. That is to say, the slots 22, 24 in the opposite side edges of the respective upper and lower panels 14, 16 align horizontally with each other across the respective panels and each slot 22 in the upper panel 14 also aligns vertically with a corresponding slot 24 in the lower panel 16.

With reference now to FIGS. 4 and 5 the slots 22, 24 on the front edges of the respecitve horizontal panels are adapted to receive with slight clearance, the upper and lower end parts 26, 28 of front retaining members 30 and the slots 22, 24 on the panel rear edges are adapted to receive the upper and lower end parts 32, 34 of rear retaining members 36. Each of the end parts 26, 28 of the front retaining members have a depth not greater than the depth of the respective slots 22, 24 whereby an upper strip 38 may be screwed to the front side edge of the upper panel to loosely trap the upper end parts of the front retaining members in the slots after they have been inserted thereinto. Similarly the lower end parts 28 may be loosely trapped in slots 24 but for the lower slots the trapping strip is desirably the vertical leg 40 of a right-angled channel 42 having a horizontal leg 44 which closes the open lower ends of the lower front slots 24 to prevent the lower end parts 28 of the retaining members 30 from dropping through the slots by gravity. Both the upper and lower end parts of the front retainers are elongated for reasons which will become apparent.

The front and rear retaining members 30, 36 are right angle channel members, preferably of extruded metal or plastic, the front members 30 having two side walls 46, 48 and the rear members likewise having two side walls, 50, 52. The side walls 50, 52 of the rear members 36 co-terminate at each end and it is the upper and lower ends 32, 34 of the side walls 50 which are received in the respective slots 22, 24, with the side wall 52 abutting the rear side edges of the respective panels 14, 16. Lower and upper right angle channels **42*a*, 42*b* having side walls 43*a* and 43*b* and 44*a*, 44*b*, respectively can be fastened to the upper and lower panels over the upper and lower ends of the rear retaining members 36. All of the channels 42, 42*a*, 42*b* can be fastened in place by screws 45 passing vertically through pre-drilled holes into the respective upper and lower faces of the panels 14, 16**.

The arrangement, as so far described is such that, when assembled, the angle 54 (FIG. 2) defined by the side walls 46, 48 of each of the front retainers 30 face inwardly in one direction, say to the right in FIGS. 2, 4, 5 and 7, and the angle 56 defined by the side walls 50, 52 of each of the rear retainers 36 face inwardly in the opposite direction with the side walls 48, 50 of the respective channels 30, 36 being parallel to a side edge of the respective top and bottom panels 14, 16 and the other respective side walls 46, 52 of corresponding chanels being aligned with each other whereby each angle, say angle 54, as best seen in FIG. 2, of the front retainer defines with a diagonally disposed angle, say angle 56 of a rear retainer, a rectangular vertical chute corresponding in cross-section to an article shown in phantom at 58 in FIG. 2. One side of each end chute is defined by respective strips 59, 60 secured to the respective front and rear vertical edges of the end panels 10, 12.

The side walls 48 of the lower ends of the front retainers are cut-away to define openings 61 at the bottom of each chute through which the articles stacked in each chute may be withdrawn. In accordance with the invention, each side wall is cut-away a length equal to at least the depth of two articles. The reason for this is that as the lower-most article, say a package of cigarettes is withdrawn, the package immediately above cocks upwardly on the upper rear edge of the pack being withdrawn and unless the opening 61 is high enough the cocked package would jamb against the wall 48 and it is difficult to unjamb the stack of packages. An opening 61 of at least twice the thickness of two packages prevents this, it being a simple matter for a person withdrawing the lower-most package to hold back the next package above though it has been found that the lower-most package usually withdraws freely without pulling with it the next package above.

The upper ends of the side walls 48 of the front retainers are also cut-away to define openings 62 at the upper end of each chute as best seen in FIG. 1. Not only do the upper cut-aways define loading openings but they also permit each front retainer 30 to be raised until the lower end parts 28 clear the slots 24 in the lower panel whereby a front retainer may be entirely removed in order to facilitate loading after which the retainer is replaced.

The lower ends of the walls 50 of the rear retainer 36 are provided with sloping slots 64, as best seen in FIG. 5, to receive the edge of a unitary strip 66 which may also be slotted at 64' as shown, the arrangement being such that the strip may be supported in the slots 64 in a sloping disposition so that its upper face defines a downwardly and forwardly sloping surface adjacent the upper surface of the lower panel 16 and facing in the direction of the openings 61 in the front retainer 30. The sloping strip 66 causes a lower-most article of each stack to extend partly clear of the stack through the opening as illustrated best at 68 in FIG. 3.

With particular reference to FIGS. 1 and 3, the end panels 10 and 12 have lower extensions 70, 72 which may be shaped to support a right angle channel member 74 in a slightly rearwardly tipped disposition as shown in FIG. 3. A support member, such as the rod 76 shown, has its opposite ends received in blind holes 77 in the end panel extensions 70, 72 and spaced in parallel relationship above the channel 74 a distance not greater than the height of any article received in the chutes, the arrangement being such that when the rack is assembled, an article 78 (FIGS. 1 and 3) corresponding to the articles stacked in the respective chutes may be positioned in an upright position on the channel 74 directly beneath that chute containing a stacked supply of that particular article.

Though the assembled rack may be supported from its position of use in any of a variety of ways, one supporting means may comprise legs 80, 82 of channel section. One leg of each channel may be screwed to an end panel 10, 12, as shown in FIGS. 1 and 2, and the other leg may be screwed to a vertical support surface. The legs may have a length such that they may rest on a horizontal support surface.

Figure 6:
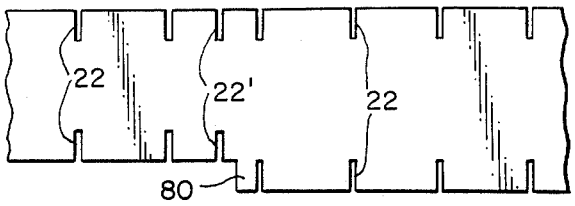
FIG. 6 is a broken plan view showing how the rack may be modified to receive articles of different sizes.

FIG. 6 illustrates a minor alternative in the basic design and shows how the invention may be modified to accomodate articles of different depths simply by increasing the horizontal depth of sections of the upper and lower panels as shown at 80 in FIG. 6. Clearly, chutes of different widths can be provided by varying the spacing between the slots as indicated at 22' in FIG. 6.

FIG. 7 illustrates the rack in its knock-down condition and only the primary reference characters are applied to the individual components. It should be apparent from FIG. 7 that the rack can be readily shipped in a knock-down or disassembled condition and substantially no talent is required to assemble the rack at its place of intended use. As should be obvious almost upon inspection, the assembler first inserts the rod 76 in the blind holes 77 in the end panel extensions 70, 72 and then attaches the top, bottom and end panels together by screws inserted through and into pre-drilled holes in the panels. He then inserts the end parts 26, 28 of the front retainer members 30 into the slots 22, 24 in the panels 14, 16 and loosely traps the ends parts of the retainers in the slots by screwing the upper strip 38 and the lower channel 42 over the open end of the slots. The assembler then attaches the ejection strip 66 to the slots 64 in the lower ends of the legs 50 of the rear retainers 36 and inserts the end parts 32, 34 of the rear retainers into the upper and lower slots 22, 24 along the rear edges of the horizontal panels. The slots 64 and mating slots 64' (if any) in the strip 66 are so positioned that when the end parts 32, 34 of the retainers are inserted in the panel slots, the strip engages the upper face of the lower panel and is thereby prevented from being withdrawn from the slots 64 as can best be seen in FIG. 3. Thereafter the rear lower and upper channels **42*a*, 42*b* are screwed in place and the support channel 74** is also screwed in place.

Where the span of the horizontal panels is of such length that the weight of the stacked articles might bow the panels downwardly, this can be prevented by pre-drilling the vertical walls **43*a*, 43*b* of the channels 42*a*, 42*b* to align with pre-drilled holes in the upper and lower ends of at least some of the side walls 52 of the rear retainers 36** whereby screws through these aligned holes into the rear side edges of the upper and lower panels provide sufficient bracing to prevent bowing.

As so far described the only tools the assembler requires is a simple set of instructions and a screw driver. If the assembled unit is to be mounted in an elevated position, it may be desirable to employ the legs 80, 82. If so, it may be necessary to drill pilot holes for screws in a vertical support surface and it may be necessary to hack saw the ends of the legs off so that they engage a horizontal support surface at an appropriate heighth.

Though the article display and support channel 74 is shown in FIG. 3 facing in the same direction as the withdrawal openings 61' it will be apparent that the assembler can merely reverse the end panels prior to assembly so that the display support faces outwardly for viewing by prospective customers while the withdrawal openings 60 face inwardly for ready access by the cashier at, say, a self-service gas station, the customer making his selection from the display and the cashier quickly withdrawing the selected brand from the appropriate opening of the chute immediately above the selected brand.

From FIG. 7 it will be apparent that the knock-down rack can be compactly packed into a relatively small package for easy shipment to customers. Though the invention is susceptable of a variety of changes and modifications it will be apparent that such cannot be made without departing from the scope and spirit of the appended claims.

What is claimed:

1. A knock-down rack for dispensing articles stacked in side-by-side vertical rows in said rack comprising a pair of end panels and top and bottom panels adapted to be connected in horizontal relationship to said end panels, said top and bottom panels having horizontal parallel side edges, a plurality of slots in the side edges of said top and bottom panels normal to said side edges, the spacing between any two adjacent slots being the same in each edge of both of said panels whereby when said horizontal panels are assembled to said end panels all of the slots in one side edge of a panel align horizontally with the slots in the other side edge of said panel and also align vertically with the slots in the side edges of the other of said panels, a plurality of front and rear retainer members each having end parts for reception in a pair of vertically aligned slots in the respective panels, strips engageable with the respective side edges of said horizontal panels for loosely trapping the end parts of at least the front retainer members within said slots, means for assembling together said top, bottom and end panels, and means for assembling said strips to said panels over said slots following insertion of said end parts of at least said front retainer members into said slots, said retainer members being channels having side walls at right angles to each other, the end parts for reception in said slots being one of said side walls, each of said front retainer members when assembled on one side of said rack having its other side wall facing in one direction parallel to the side edges of the top and bottom panels, each of said rear retainer members when assembled on the other side of said rack having its other side wall facing in the opposite direction parallel to the side edges of the top and bottom panels whereby the side walls of a retainer member on one side of the rack defines with the side walls of a diagonally disposed retainer on the other side of the rack a rectangular open sided vertical chute corresponding to the cross section of articles stacked in said chute.

2. The knock-down rack of claim 1, wherein the side walls which are parallel to one edge of each of said top and bottom panels of at least the front retainer members, when said channels are assembled to said panels, are cut-away at the bottom end to define openings enabling withdrawal of the bottom-most one of a plurality of articles stacked in said chute.

3. The knock-down rack of claim 2, including a member attachable to the lower ends of the rear retainer members adjacent the upper surface of said lower panel, said member having a downwardly and forwardly sloping surface facing in the direction of the openings of the front retainer members to cause a lower-most article of each stack to extend partly clear of said stack through said opening.

4. The knock-down rack of claim 2, wherein the cut-away at the bottom of said front channels has a heighth at least equal to the depth of two lower-most articles stacked in each chute in order to permit the withdrawal of the lower-most article without causing the next above front jamb in said chute.

5. The knock-down rack of claim 1, wherein the end panels have lower extensions, a channel having end parts adapted to be connected to the lower rear ends of said extensions, support means adapted to be connected to said extensions above said channel and parallel thereto a distance not greater than the heighth of an article contained in said chutes whereby when said rack is assembled an article corresponding to the articles stacked in each chute may be positioned in an upright position on said channel directly beneath the chute containing said articles.

6. The knock-down rack of claim 2, wherein said side walls having the cut-away withdrawal openings therein are also cut-away at their upper ends a distance at least sufficient to enable each of said retainers to be elevated relative to said panels and temporarily removed to facilitate loading of said chutes.

7. The knock-down rack of claim 6, wherein the cut-aways at the upper ends have a length through which articles can be loaded into said chutes without removing said retainer.

8. The knock-down rack of claim 3, wherein said member is a continuous strip and the lower ends of said rear retainer members have sloping slots for receiving said member, said slots being so positioned that when said member is received therein and the rear retainer members are assembled to said panels said member is prevented from being disengaged from said slots by engagement of the lower edge of said member with the upper horizontal surface of the lower panel member.

9. The knock-down rack of claim 1 including a strip engageable with the lower surface of the lower panel beneath at least the slots for said front retainers to provide a support for the lower ends of said front retainers.

10. The knock-down rack of claim 9, wherein said strip is the leg of a right angle channel member, the other leg defining said strip for trapping within their slots the lower end parts of at least the front retainer members.

* * * * *